US008893916B2

(12) United States Patent
Takeyama et al.

(10) Patent No.: US 8,893,916 B2
(45) Date of Patent: Nov. 25, 2014

(54) HOT WATER STORAGE TANK UNIT

(71) Applicant: Mitsubishi Electric Corporation, Tokyo (JP)

(72) Inventors: Kei Takeyama, Tokyo (JP); Taro Hattori, Tokyo (JP); Kazutaka Suzuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/045,934

(22) Filed: Oct. 4, 2013

(65) Prior Publication Data

US 2014/0138390 A1 May 22, 2014

(30) Foreign Application Priority Data

Nov. 16, 2012 (JP) ..... 2012-251975

(51) Int. Cl.

| | |
|---|---|
| ***B65D 88/74*** | (2006.01) |
| ***F24H 9/06*** | (2006.01) |
| ***F24D 11/02*** | (2006.01) |
| ***F24D 19/00*** | (2006.01) |
| ***F24H 9/14*** | (2006.01) |

(52) U.S. Cl.

CPC ..... *F24D 19/0097* (2013.01); *F24H 9/06* (2013.01); *F24D 11/0214* (2013.01); *F24H 9/148* (2013.01)

USPC ..... 220/567.3; 220/694.1; 220/636; 220/592.28

(58) Field of Classification Search

USPC ..... 220/694.1, 636, 635, 634, 632, 630, 220/592.28, 592.26, 567.3; 248/694, 688, 248/678, 633, 188.91, 188.9, 188.8, 188.7, 248/188.2, 188.1, 176.2, 163.1, 121

See application file for complete search history.

(56) References Cited

U.S. PATENT DOCUMENTS

| | | | | | |
|---|---|---|---|---|---|
| 2,303,126 | A | * | 11/1942 | Koppel | 220/567.3 |
| 2,792,231 | A | * | 5/1957 | Compton | 280/837 |
| 4,253,426 | A | * | 3/1981 | Nishi et al. | 122/17.2 |
| 2013/0112822 | A1 | * | 5/2013 | Ishiwata | 248/188.8 |

FOREIGN PATENT DOCUMENTS

| | | | |
|---|---|---|---|
| JP | 2005-226965 | A | 8/2005 |
| JP | 2007-155274 | A | 6/2007 |

* cited by examiner

*Primary Examiner* — Steven A. Reynolds
*Assistant Examiner* — Mollie Llewellyn
(74) *Attorney, Agent, or Firm* — Posz Law Group, PLC

(57) ABSTRACT

[Solution] A metal cylindrical tank leg 20 forming an opening in a portion opposite to the lower end plate 7*b* is provided on the lower end plate 7*b* of the hot water storage tank 7, a plurality of metal L-shaped tank legs 21 one edge 21*a* of each of which extends outwardly are provided on the outer peripheral surface of the cylindrical tank leg 20 and arrayed in a circumferential direction thereof, a base plate made of a metal is fixed to the second tank legs; and the cylindrical tank leg 20 and the L-shaped tank legs 21 are fixed to a base plate 12*b* with a base heat insulator 23 having an electrical insulation property and elasticity interposed therebetween. Part of the lower end plate 7*b* located within the opening of the cylindrical tank leg 20 is covered by an end plate heat insulator 22.

6 Claims, 6 Drawing Sheets

HOT WATER STORAGE TANK UNIT

TECHNICAL FIELD

The present invention relates to a hot water storage tank unit used, for example, in a water heater and hot water equipment.

BACKGROUND ART

Hitherto, in the above-stated type of hot water storage tank unit, a heat insulator has been placed on the outer peripheral surface of the hot water storage tank to reduce the amount of heat transfer.

For example, there has been proposed a configuration in which a vacuum heat insulator that is expensive but has a high heat insulation property and can suppress heat transfer to a small volume is applied to a part of this configuration where the amount of heat transfer is large, while a heat insulator that is less expensive than the vacuum heat insulator but is inferior to the vacuum heat insulator in heat insulating property is applied to the other parts, so that the cost and product size are thereby reduced (see, for example, Patent Literature 1).

There has been proposed a configuration in which the vacuum heat insulator is applied only to a dimensionally constrained part, a heat insulator that is inferior to the vacuum heat insulator in heat insulating property but is less expensive than the vacuum heat insulator is applied to dimensionally unconstrained parts, and both the cost and product size are thereby reduced (see, for example, Patent Literature 2).

CITATION LIST

Patent Literature

[Patent Literature 1] Japanese Unexamined Patent Application Publication No. 2007-155274

[Patent Literature 2] Japanese Unexamined Patent Application Publication No. 2005-226965

SUMMARY OF INVENTION

Technical Problem

However, in the arts described in Patent Literatures 1 and 2, although heat insulation property and reduction in cost and size are considered, there is a problem that the fixation and heat insulation structure of the hot water storage tank are not stable, the hot water storage tank may become unstable when the hot water storage tank is large or in a high mass state, for example, filled with hot water, and bringing them into the practical use is difficult.

If the hot water storage tank is directly fixed to a metal base plate having a sufficient strength, there is fear that heat is transferred from the hot water storage tank to the metal base plate, and the heat loss increases. When the hot water storage tank and the metal base plate are made of different metals, galvanic corrosion is a concern.

The present invention has been made to solve the above problems, and it is an object of the present invention to provide a hot water storage tank unit in which a hot water storage tank can be stably fixed even if the hot water storage tank is in a high mass state, galvanic corrosion can be prevented, and the heat leakage from hot water in the hot water storage tank can be suppressed.

Solution to Problem

A hot water storage tank unit according to the present invention includes a hot water storage tank that stores hot water, a first tank leg made of a metal provided on a lower end plate of the hot water storage tank, the first tank leg forming an opening in a portion opposite to the lower end plate, a plurality of second tank legs made of a metal provided on an outer peripheral surface of the first tank leg and arrayed in a circumferential direction thereof and one edge of each of which extends outwardly, a base plate made of a metal fixed to the second tank legs, a first heat insulator placed so as to cover part of the lower end plate, the part being located within the opening of the first tank leg, and a second heat insulator provided between the first and second tank legs and the base plate and having an electrical insulation property.

Advantageous Effects of Invention

According to the present invention, a first tank leg made of a metal forming an opening in a portion opposite to the lower end plate is provided on the lower end plate of the hot water storage tank, a plurality of second tank legs made of a metal one edge of each of which extends outwardly are provided on the outer peripheral surface of the first tank leg and arrayed in a circumferential direction thereof, a base plate made of a metal is fixed to the second tank legs and the first and second tank legs are fixed to the base plate with a second heat insulator having an electrical insulation property interposed therebetween.

Owing to this configuration, if the hot water storage tank is in a high mass state, the load is distributed through the second tank legs, and therefore the installation state is stable, and a highly practical hot water storage tank unit can be provided.

Since a second heat insulator having an electrical insulation property is interposed between the metal first and second tank legs and the metal base plate, if the first and second tank legs and the base plate are made of different metals, galvanic corrosion can be prevented, sufficient strength can be kept in a prolonged use, the safety is high, and the corrosion resistance is excellent.

By having the second heat insulator, the heat transfer from the lower end plate of the hot water storage tank can be suppressed. Since part of the lower end plate located within the opening of the first tank leg is covered by a first heat insulator, the heat transfer from the lower end plate of the hot water storage tank to the base plate can be suppressed, the heat insulation property is thereby improved, and a highly energy-saving hot water storage tank unit can be provided.

DESCRIPTION OF EMBODIMENTS

Figure 1:
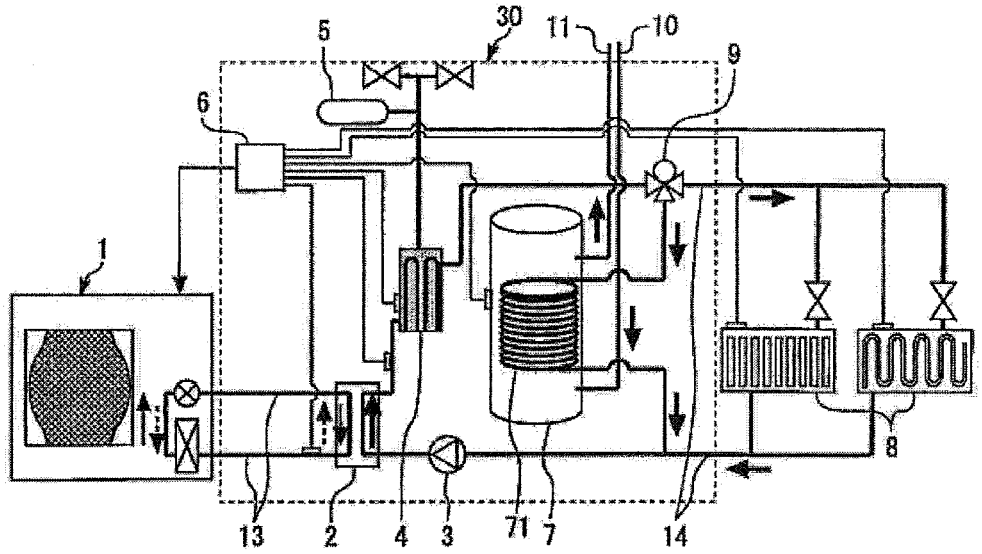
FIG. 1 is a schematic configuration diagram of an air-conditioning system to whose indoor unit a hot water storage tank according to Embodiment of the present invention is applied.

FIG. 1 is a schematic configuration diagram of an air-conditioning system to whose indoor unit a hot water storage tank according to Embodiment of the present invention is applied.

The air-conditioning system shown in FIG. 1 includes an outdoor unit 1 (heat pump unit) 1 of an air-conditioning apparatus, an indoor unit (cylinder unit) 30 including devices including a hot water storage tank unit having a hot water storage tank 7 that stores hot water, and an indoor radiator 8. The outdoor unit 1 is configured so as to be able to operate a heat pump cycle (refrigeration cycle). The indoor radiator 8 includes a floor heating panel or a radiator.

This air-conditioning system is configured as a heat pump hot water supply system that exchanges heat between refrigerant in a refrigerant circuit of the heat pump and water in a water circuit, circulates this water, thereby can heat the water stored in the hot water storage tank 7, and can perform room cooling operation and heating using the indoor radiator 8 provided in the water circuit.

The outdoor unit 1 and the indoor unit 30 are connected to each other by a refrigerant pipe 13 and electric wiring. The outdoor unit 1 has a refrigerant circuit including an air-refrigerant heat exchanger that exchanges heat between outdoor air and refrigerant, a compressor that compresses refrigerant, and an expansion valve. The indoor unit 30 and the indoor radiator 8 are connected to each other by water pipes 14 and electric wiring.

The indoor unit 30 includes, in addition to the hot water storage tank unit, a water-refrigerant heat exchanger 2 that exchanges heat between the refrigerant in the refrigerant circuit and the water in the water circuit, a pump 3 that circulates the water in the water circuit, a booster heater 4 that further and supplementarily heats the hot water heated in the water-refrigerant heat exchanger 2 at the time of room heating operation, an expansion tank 5 that absorbs the pressure in the water circuit, a controller 6 that controls the operation of this system, and a three-way valve 9 serving as a flow switching means that switches the destination of the water having been subjected to heat-exchange in the water-refrigerant heat exchanger 2. The water-refrigerant heat exchanger 2 is connected by refrigerant pipes 13 to the outdoor unit 1. The three-way valve 9 switches the destination of water in response to a control signal from the controller 6.

In FIG. 1, the thin solid arrows indicate the direction in which refrigerant flows at the time of room heating operation, the dashed arrows indicate the direction in which refrigerant flows at the time of room cooling operation, and the thick solid arrows indicate the direction in which water flows. The components within the dashed frame are components of the indoor unit 30, and the thin solid lines indicate signal lines (wiring) to the controller 6.

The above-described hot water storage tank unit includes a hot water storage tank 7, a metal cylindrical tank leg (first tank leg) provided on the lower end plate of the hot water storage tank 7, a plurality of metal L-shaped tank legs (second tank legs) provided on the outer peripheral surface of the cylindrical tank leg to be arrayed in the circumferential direction thereof, an end plate heat insulator (first heat insulator) placed so as to cover part of the lower end plate, the part being located within the opening of the cylindrical tank leg, and a base heat insulator (second heat insulator) provided between the cylindrical tank leg and the L-shaped tank legs and a base plate. These will be described later. An in-tank heat exchanger 71 that exchanges heat between the water in the water circuit and the water stored in the hot water storage tank 7 is placed in the hot water storage tank 7.

At the time of room heating operation, or at the time of water heating operation in which the water stored in the hot water storage tank 7 is heated, refrigerant flows between the outdoor unit 1 and the water-refrigerant heat exchanger 2 in the direction of the thin solid arrows. In this case, the water pumped into the water-refrigerant heat exchanger 2 by the pump 3 is heated in the water-refrigerant heat exchanger 2 by the refrigerant from the outdoor unit 1 and becomes hot water. This hot water reaches the three-way valve 9 through the booster heater 4, and flows to either the indoor radiator 8 or the in-tank heat exchanger 71.

When the three-way valve 9 is switched to the indoor radiator 8 side, the hot water circulates in the indoor radiator 8, and the room in which the indoor radiator 8 is placed is brought into a heated state. When the three-way valve 9 is switched to the in-tank heat exchanger 71 side, the hot water circulates in the in-tank heat exchanger 71, and heats the water stored in the hot water storage tank 7. The hot water passing through either the indoor radiator 8 or the in-tank heat exchanger 71 becomes low-temperature water, and the water returns to the water-refrigerant heat exchanger 2 through the pump 3, is heated again by the refrigerant from the outdoor unit 1, and circulates.

At the time of room cooling operation, refrigerant flows between the outdoor unit 1 and the water-refrigerant heat exchanger 2 in the direction of the dashed arrows in FIG. 1. In this case, the water pumped into the water-refrigerant heat exchanger 2 by the pump 3 is cooled in the water-refrigerant heat exchanger 2 by the refrigerant from the outdoor unit 1 and becomes cold water. By circulating this cold water in the indoor radiator 8 by the same route as above, the room is brought into a cooled state.

The hot water storage tank 7 has a substantially cylindrical shape, and at least the outer shell thereof is formed of a metal material such as stainless steel. A water supply pipe 10 that supplies water from the outside of this system, such as tap water, is connected to the lower part of the shell plate of the hot water storage tank 7. The water supplied from the water supply pipe 10 flows into the hot water storage tank 7 and is stored therein. By performing the above-described water heating operation, the water stored in the hot water storage tank 7 is heated, and hot water is generated. In the hot water storage tank 7, a temperature stratification in which the temperature is high in the upper part and is low in the lower part is formed, and hot water is stored.

A hot water outlet pipe 11 for taking out hot water generated in the hot water storage tank 7 is connected to the upper part of the shell plate of the hot water storage tank 7. The hot water generated in the hot water storage tank 7 is supplied to the outside of this system through the hot water outlet pipe 11, and is used as domestic water or the like. The hot water storage tank 7 is provided with, in addition to the end plate heat insulator and the base heat insulator, a shell plate heat insulator and an upper part heat insulator so that the heat transfer from the stored hot water is suppressed. These heat insulators will be described later.

Figure 2:
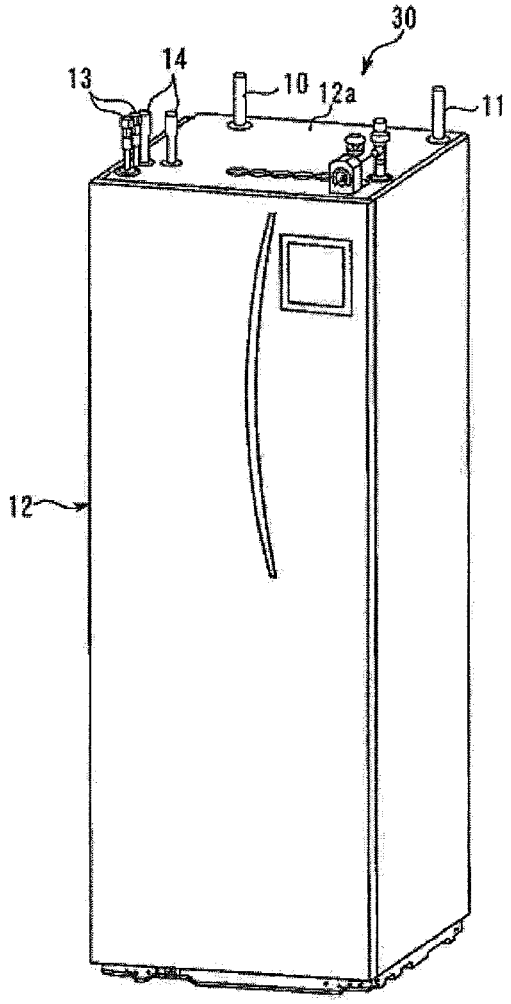
FIG. 2 is a perspective view showing the appearance of the indoor unit of FIG. 1.
Figure 3:
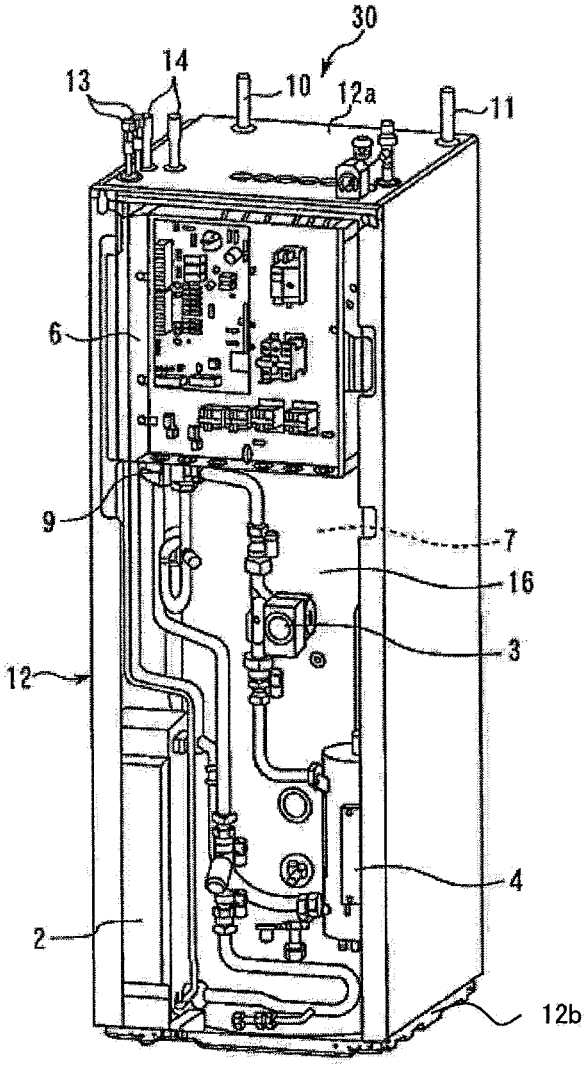
FIG. 3 is a perspective view of the indoor unit, with the front decorative panel of the indoor unit of FIG. 2 removed.
Figure 4:
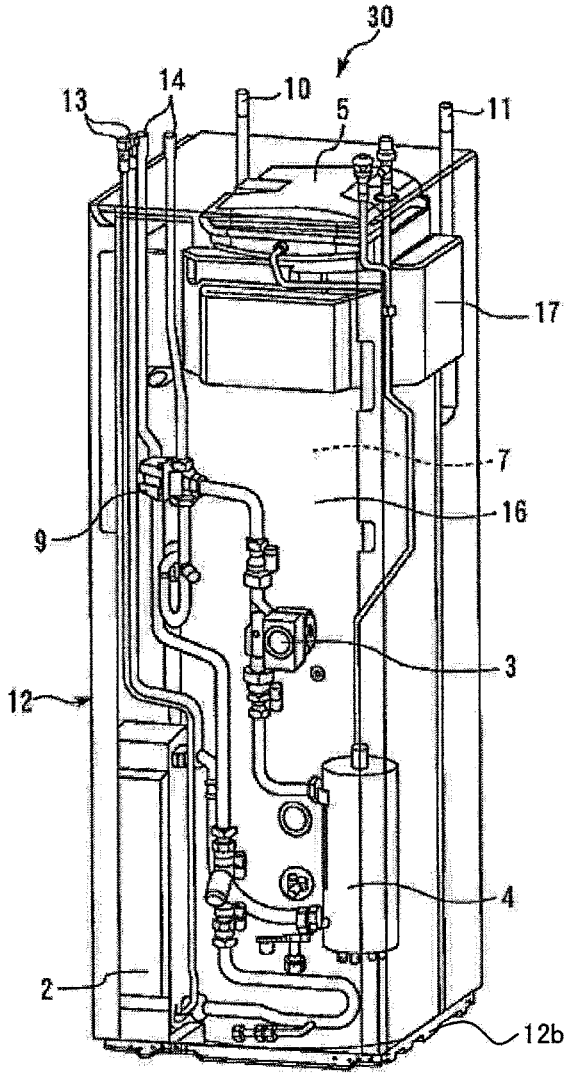
FIG. 4 is a perspective view of the indoor unit, with the upper and side decorative panels of the indoor unit of FIG. 3 in phantom.

FIG. 2 is a perspective view showing the appearance of the indoor unit of FIG. 1. FIG. 3 is a perspective view of the indoor unit, with the front decorative panel of the indoor unit of FIG. 2 removed. FIG. 4 is a perspective view of the indoor unit, with the upper and side decorative panels of the indoor unit of FIG. 3 in sight through. FIG. 4 shows a state where the controller 6 shown in FIG. 3 is removed.

The indoor unit 30 is formed, for example, so as to have a substantially rectangular parallelepiped appearance as shown in FIG. 2, and is covered by decorative panels 12 formed by painting sheet metal or the like. As shown in FIG. 3 and FIG. 4, devices such as the above-described water-refrigerant heat exchanger 2, pump 3, booster heater 4, expansion tank 5, controller 6, hot water storage tank 7, three-way valve 9, and pipes are housed in the indoor unit 30. As shown in FIG. 2 and FIG. 3, the upper decorative panel 12*a* of the indoor unit 30 is provided with a plurality of holes for passing the refrigerant pipes 13 connecting the indoor unit 30 and the outdoor unit 1, the water pipes 14 connecting the indoor unit 30 and the indoor radiator 8, and the water supply pipe 10 and the hot water outlet pipe 11 connected to the indoor unit 30 from the outside of this system.

The indoor unit 30 is installed, for example, in a room including a shower room. In a usage environment where a shower is used near the indoor unit 30, water may be spattered on the indoor unit 30. The live parts of electric devices disposed in the indoor unit 30 and the controller 6 are waterproofed, and deterioration and malfunction of the devices in the indoor unit 30 due to entrance of water are prevented.

Figure 5:
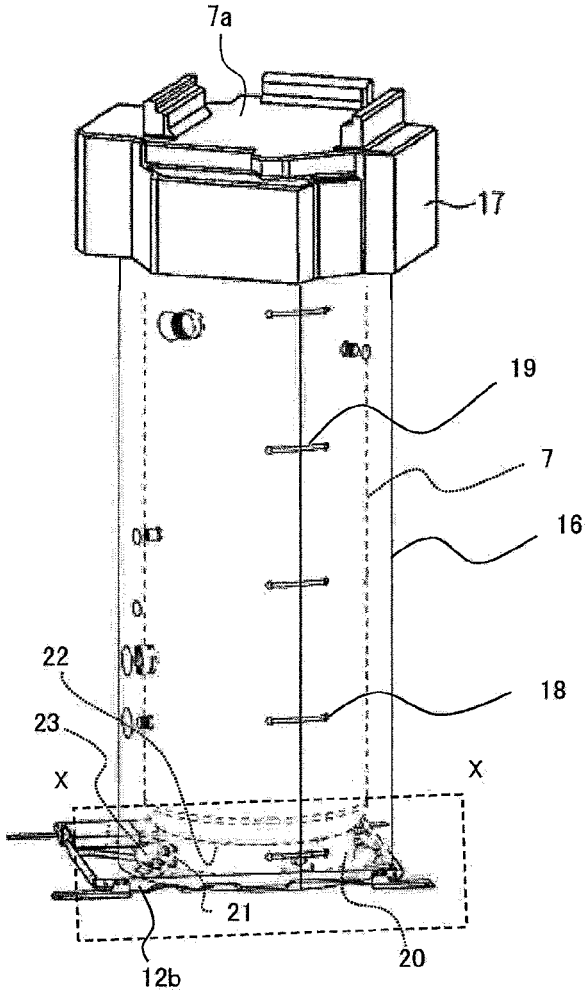
FIG. 5 is a perspective view showing the upper part heat insulator and the shell plate heat insulator provided on the hot water storage tank of FIG. 1.
Figure 6:
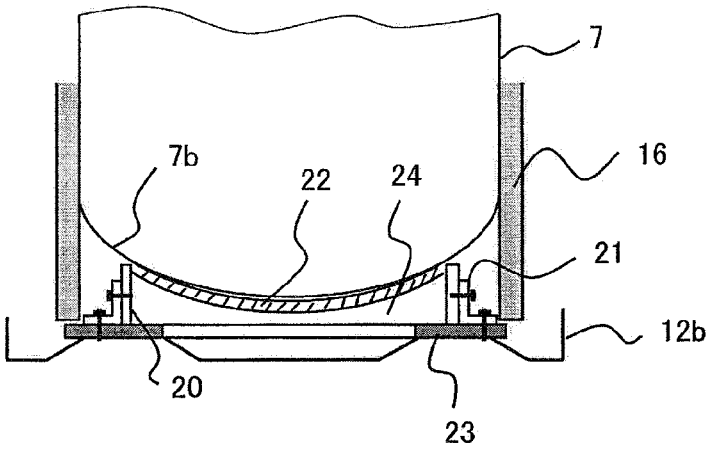
FIG. 6 is a vertical enlarged sectional view of the lower part of the hot water storage tank surrounded by dashed line X-X shown in FIG. 5.
Figure 7:
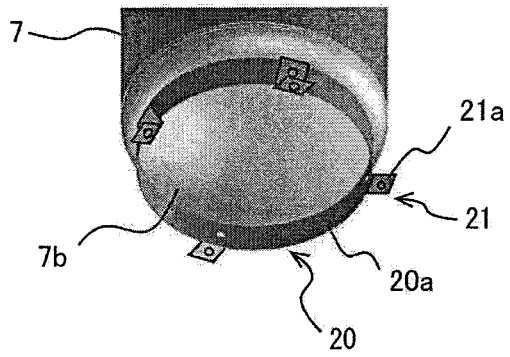
FIG. 7 is a perspective view of the lower end plate of the hot water storage tank of FIG. 5 viewed from below.
Figure 8:
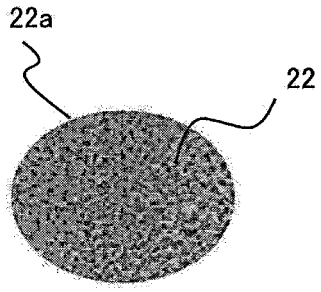
FIG. 8 is a perspective view of the end plate heat insulator covering the lower end plate shown in FIG. 7.
Figure 9:
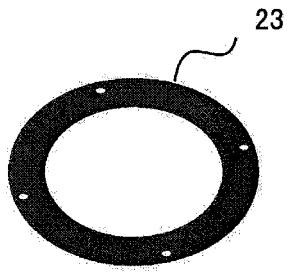
FIG. 9 is a perspective view of the base heat insulator shown in FIG. 6.

FIG. 5 is a perspective view showing the upper part heat insulator and the shell plate heat insulator provided on the hot water storage tank of FIG. 1. FIG. 6 is a vertical enlarged sectional view of the lower part of the hot water storage tank surrounded by dashed line X-X shown in FIG. 5. FIG. 7 is a perspective view of the lower end plate of the hot water storage tank of FIG. 5 viewed from below. FIG. 8 is a perspective view of the end plate heat insulator covering the lower end plate shown in FIG. 7. FIG. 9 is a perspective view of the base heat insulator shown in FIG. 6.

As shown in FIG. 5 and FIG. 6, the hot water storage tank 7 has an upper end plate 7*a* at the upper end of the cylindrical shell plate, and a lower end plate 7*b* at the lower end of the shell plate. An upper part heat insulator 17 (third heat insulator) formed of a heat insulating material such as expandable polystyrene is provided on the outer peripheral surface of the upper part of the cylindrical shell plate and at least part of the upper end plate 7*a*. The heat leakage from the upper part of the hot water storage tank 7 is suppressed by the upper part heat insulator 17.

The outer peripheral surface of the shell plate of the hot water storage tank 7 is wrapped with a shell plate heat insulator 16 (fourth heat insulator) except for the upper part heat insulator 17. The shell plate heat insulator 16 forms a substantially rectangular sheet shape when it is not attached to the hot water storage tank 7. The length of the shell plate heat insulator 16 in the height direction of the hot water storage tank 7 (in the vertical direction) is substantially the same as the distance between the lower end of the upper part heat insulator 17 and a base heat insulator 23 (see FIG. 6) located below the lower end plate 7*b* of the hot water storage tank 7. Therefore, the upper end of the shell plate heat insulator 16 is in contact with the upper part heat insulator 17, the lower end of the shell plate heat insulator 16 is in contact with the base heat insulator 23, and the heat leakage through the gaps is reliably suppressed.

The length of the shell plate heat insulator 16 in the direction perpendicular to the height direction of the hot water storage tank 7 (the length in the horizontal direction) is substantially the same as the length of the circumference of the shell plate of the hot water storage tank 7. Therefore, the shell plate heat insulator 16 forms a cylindrical shape when it is wrapped around the hot water storage tank 7, and covers substantially the entire outer peripheral surface of the shell plate of the hot water storage tank 7. When the shell plate heat insulator 16 is wrapped around the shell plate of the hot water storage tank 7, both ends of the shell plate heat insulator 16 face each other and are close to each other. In this state, a connecting band 19 is passed through connecting holes 18 provided in both ends of the shell plate heat insulator 16, and both ends are sewn together. The connecting band 19 is made of a resin material having a heat resistance property, and the sawing work can be performed by hand without using a special tool. Therefore, the shell plate heat insulator 16 can be easily fixed tightly to the outer peripheral surface of the shell plate of the hot water storage tank 7.

As shown in FIG. 6, the hot water storage tank 7 is fixed in a self-supporting manner in the indoor unit 30 by a metal cylindrical tank leg 20 (first tank leg) attached to the lower end plate 7*b* and forming an opening in a portion opposite to the lower end plate 7*b*, a plurality of metal L-shaped tank legs 21 (second tank legs) fixed to the outer peripheral surface of the cylindrical tank leg 20, and a metal base plate 12*b* fixed to the plurality of L-shaped tank legs 21 with the base heat insulator 23 interposed therebetween. The base plate 12*b* is formed of a metal having a strength sufficient to withstand the weight of the indoor unit 30 including the hot water storage tank 7 filled with water. The base plate 12*b* has end portions formed in an L-shape and a central portion recessed downwardly. The surface of the central portion is coplanar with the horizontal parts of the end portions.

The cylindrical tank leg 20 is joined to the lower end plate 7*b* by welding. As shown in FIG. 7, the number of the L-shaped tank legs 21 is, for example, four, and the L-shaped tank legs 21 are fixed to the outer peripheral surface of the cylindrical tank leg 20 to be arrayed in a circumferential direction, and are joined to the outer peripheral surface of the cylindrical tank leg 20 with bolts or by welding. The L-shaped tank legs 21 are disposed in such a manner that one edge 21*a* of each of the L-shaped tank legs 21 extending outwardly from the outer peripheral surface of the cylindrical tank leg 20 is coplanar with the lower end face 20*a* of the cylindrical tank leg 20. Since one edge 21*a* of each of the L-shaped tank legs 21 is coplanar with the lower end face 20*a* of the cylindrical tank leg 20, the load of the hot water storage tank 7 can be distributed, and the hot water storage tank 7 is resistant to overturning. The shape of the cylindrical tank leg 20 is not limited to a cylindrical shape as long as the hot water storage tank 7 can be stably erected in a self-supporting manner.

An end plate heat insulator 22 (first heat insulator) having, for example, a shape shown in FIG. 8 (for example, a circular shape) is placed on part of the lower end plate 7*b*, the part being located within the opening of the cylindrical tank leg 20 so as to be in close contact with the surface of the lower end plate 7*b*. By placing the end plate heat insulator 22, the heat transfer from the lower end plate 7*b* to the space between the lower end plate 7*b* and the base plate 12*b* can be prevented. Owing to the water temperature distribution in the hot water storage tank 7, the amount of heat transfer from the lower end plate 7*b* is relatively small. Therefore, the end plate heat insulator 22 is made of non-woven fabric such as felt. This non-woven fabric such as felt is an inexpensive material although it is inferior to the shell plate heat insulator 16 and the upper part heat insulator 17 in heat insulation performance.

The external dimension of the end plate heat insulator 22 is greater than the internal diameter of the opening of the cylindrical tank leg 20. Therefore, the end plate heat insulator 22 is press-fitted within the inner wall of the cylindrical tank leg 20. Since the lower end plate 7*b* has a spherical shape, the lower end plate 7*b* makes an acute angle with the inner wall of the cylindrical tank leg 20. Therefore, the outer peripheral end face 22*a* of the end plate heat insulator 22 can be press-fitted, and the holding structure of the end plate heat insulator 22 can be easily assembled. The shape of the end plate heat insulator 22 is not limited to a circular shape shown in FIG. 8 as long as the external dimension of the end plate heat insulator 22 is greater than the internal diameter of the cylindrical tank leg 20.

The base heat insulator 23 (second heat insulator) is fixed between the cylindrical tank leg 20 and the L-shaped tank legs 21 and the base plate 12*b* with bolts (see FIG. 6) and is formed, for example, in a ring shape as shown in FIG. 9. The base heat insulator 23 prevents the heat transfer from the L-shaped tank legs 21 and the cylindrical tank leg 20 to the base plate 12*b*. The shape of the base heat insulator 23 is not limited to the shape shown in FIG. 9 as long as the base heat insulator 23 can hold the horizontal parts 21*a* of the L-shaped tank legs 21 and the end face 20*a* of the cylindrical tank leg 20.

The base heat insulator 23 may be formed of a material having not only a heat insulation property (heat retaining property) but also elasticity and an electrical insulation property, such as rubber. In this case, the vibration at the time of transportation and operation of the indoor unit 30 can be reduced. Further, galvanic corrosion which occurs when the base plate 12*b* and the L-shaped tank legs 21 or the cylindrical tank leg 20 are made of different metal materials can be prevented, and sufficient strength can be kept in a prolonged use. Galvanic corrosion is a phenomenon in which, when different metals are in contact and immersed in an electrolyte, the metal with lower potential becomes a positive electrode, the metal with higher potential becomes a negative electrode, a local cell is formed, and metal is ionized and corrodes.

As described above, according to Embodiment, a metal cylindrical tank leg 20 forming an opening in a portion opposite to the lower end plate 7*b* is provided on the lower end plate 7*b* of the hot water storage tank 7, a plurality of metal L-shaped tank legs 21, one edge 21*a* of each of which extends outwardly are provided on the outer peripheral surface of the cylindrical tank leg 20 in the circumferential direction thereof, and the cylindrical tank leg 20 and the L-shaped tank legs 21 are fixed to a base plate 12*b* with a base heat insulator 23, having an electrical insulation property and elasticity, interposed therebetween.

Owing to this configuration, if the inside of the hot water storage tank 7 is in a high mass state, the load is distributed through the L-shaped tank legs 21, and therefore the installation state is stable, and a highly practical hot water storage tank unit can be provided.

Since a base heat insulator 23 is interposed between the cylindrical tank leg 20 and the L-shaped tank legs 21 and the base plate 12*b*, if the cylindrical tank leg 20 and the L-shaped tank legs 21 and the base plate 12*b* are made of different metals, galvanic corrosion can be prevented, sufficient strength can be kept in a prolonged use, the safety is high, and the corrosion resistance is excellent.

By placing the base heat insulator 23, the heat transfer from the lower end plate 7*b* of the hot water storage tank 7 can be suppressed. Since part of the lower end plate 7*b*, the part being located within the opening of the cylindrical tank leg 20 is covered by an end plate heat insulator 22, the heat transfer from the lower end plate 7*b* of the hot water storage tank 7 to the base plate 12*b* can be suppressed, the heat insulation property is thereby improved, and a highly energy-saving hot water storage tank unit can be provided. Since the end plate heat insulator 22 can be placed into the opening of the cylindrical tank leg 20 by hand, the cost is low and the assemblage is easy.

The vibration at the time of transportation and operation is absorbed by the base heat insulator 23 placed between the cylindrical tank leg 20 and the L-shaped tank legs 21 and the base plate 12*b*. Therefore, damage to the hot water storage tank unit can be reduced, and the quietness at the time of operation of the hot water storage tank unit can be improved.

Since the upper part of the shell plate of the hot water storage tank 7 and at least part of the upper end plate 7*a* are covered by an upper part heat insulator 17, and part of the shell plate between the lower end of the upper part heat insulator 17 and the base heat insulator 23 is covered by a shell plate heat insulator 16, the heat transfer from the gaps can be prevented.

REFERENCE SIGNS LIST

1: outdoor unit of air-conditioning apparatus, 2: water-refrigerant heat exchanger, 3: pump, 4: booster heater, 5: expansion tank, 6: controller, 7: hot water storage tank, 7*a*: upper end plate, 7*b*: lower end plate, 8: indoor radiator, 9: three-way valve, 10: water supply pipe, 11: hot water outlet pipe, 12: decorative panel, 12*a*: upper decorative panel, 12*b*: base plate, 13: refrigerant pipe, 14: water pipe, 16: shell plate heat insulator of hot water storage tank, 17: upper part heat insulator, 18: connecting hole, 19: connecting band, 20: cylindrical tank leg, 20*a*: end face of cylindrical tank leg, 21: L-shaped tank leg, 21*a*: one part of L-shaped tank leg, 22: end plate heat insulator, 22*a*: outer peripheral end face of end plate heat insulator, 23: base heat insulator, 30: indoor unit of air-conditioning apparatus, 71: in-tank heat exchanger.

The invention claimed is:

1. A hot water storage tank unit comprising:

a hot water storage tank that stores hot water;

a first tank leg made of a metal provided on a lower end plate of the hot water storage tank, the first tank leg forming an opening in a portion opposite to the lower end plate;

a plurality of second tank legs made of a metal provided on an outer peripheral surface of the first tank leg and arrayed in a circumferential direction thereof and one edge of each of which extends outwardly;

a base plate made of a metal fixed to the second tank legs;

a first heat insulator placed so as to cover part of the lower end plate, the part being located within the opening of the first tank leg; and a second heat insulator provided below the first and second tank legs and above the base plate and having an electrical insulation property.

2. The hot water storage tank unit of claim 1, wherein the first tank leg has a cylindrical shape, the second tank legs each have an L-shape, and another one edge of each of the second tank legs is fixed to the outer peripheral surface of the first tank leg in such a manner that the one edge extending outwardly from the outer peripheral surface of the first tank leg is coplanar with a lower end face of the first tank leg.

3. The hot water storage tank unit of claim 1, wherein the first heat insulator is press-fitted in the opening of the first tank leg and is thereby fixed.

4. The hot water storage tank unit of claim 1, wherein the first heat insulator is formed of non-woven fabric.

5. The hot water storage tank unit of claim 1, wherein the second heat insulator is formed of a material having elasticity in addition to an electrical insulation property.

6. The hot water storage tank unit of claim 1, further comprising a third heat insulator attached so as to cover an upper part of a shell plate of the hot water storage tank and at least part of an upper end plate of the hot water storage tank, and a fourth heat insulator wrapped around the shell plate except for the upper part of the shell plate of the hot water storage tank, wherein the fourth heat insulator covers part of the shell plate between the lower end of the third heat insulator and the second heat insulator.

* * * * *